US008723784B2

(12) United States Patent
Adachi

(10) Patent No.: US 8,723,784 B2
(45) Date of Patent: May 13, 2014

(54) BRIGHTNESS CONTROL APPARATUS, DISPLAY APPARATUS AND LIGHTING APPARATUS

(75) Inventor: Takeshi Adachi, Saitama (JP)

(73) Assignees: Mitsumi Electric Co., Ltd., Tokyo (JP); ATRC Corporation, Saitama (JP)

( * ) Notice: Subject to any disclaimer, the term of this patent is extended or adjusted under 35 U.S.C. 154(b) by 303 days.

(21) Appl. No.: 13/307,437

(22) Filed: Nov. 30, 2011

(65) Prior Publication Data

US 2012/0139968 A1 Jun. 7, 2012

(30) Foreign Application Priority Data

Dec. 1, 2010 (JP) ..... 2010-268153

(51) Int. Cl.
*G09G 3/36* (2006.01)

(52) U.S. Cl.
USPC ..... 345/102; 345/80

(58) Field of Classification Search
USPC ..... 345/102, 89
See application file for complete search history.

(56) References Cited

U.S. PATENT DOCUMENTS

| | | | | |
|---|---|---|---|---|
| 7,511,695 | B2 | 3/2009 | Furukawa et al. | |
| 2002/0147861 | A1 * | 10/2002 | Bui et al. | 710/1 |
| 2009/0153464 | A1 * | 6/2009 | Furukawa et al. | 345/102 |

FOREIGN PATENT DOCUMENTS

| | | |
|---|---|---|
| JP | 11-305198 | 11/1999 |
| JP | 2006-031977 | 2/2006 |

OTHER PUBLICATIONS

Home Theater • PC Projector's & Big Display Encyclopedia 2010 II, vol. 23, 14th issue, Jun. 1, 2010, PJ Research Institute, pp. 51-52.

* cited by examiner

*Primary Examiner* — Latanya Bibbins
(74) *Attorney, Agent, or Firm* — IPUSA, PLLC

(57) ABSTRACT

A brightness control apparatus configured to perform brightness control for backlights formed by plural light-emitting elements for a display screen, including: a pulse control signal transmit unit configured to transmit a pulse control signal for performing driving control on the plural light-emitting elements based on a preset brightness control signal; a voltage control unit configured to control a voltage of the pulse control signal obtained by the pulse control signal transmit unit for each set of light-emitting elements of the same color so as to correct brightness variation in a regular state for the plural light-emitting elements; and a current control unit configured to control a current for each of the plural light-emitting elements based on a voltage value obtained by the voltage control unit so as to correct brightness variation due to temperature change or temporal change.

6 Claims, 19 Drawing Sheets

FIG.4

| ・Vf SPREAD & DRIFT | | |
|---|---|---|
| R | 0.47V/50° | 0.0094V/1° |
| G | 0.71V/50° | 0.0142V/1° |
| B | 0.71V/50° | 0.0142V/1° |
| ・DETECTION OF Vf | | |
| 8Bit ADC → | ΔR:0.47/256=0.0018 | |
| 7Bit ADC → | ΔR:0.47/128=0.0036 | |
| 6Bit ADC → | ΔR:0.47/ 64=0.0073 | |

FIG.5A

| (1)Red | | (2)Green | | (3)Blue | | (4)BY | |
|---|---|---|---|---|---|---|---|
| THERMOCOUPLE (℃) | Vf(V) | THERMOCOUPLE (℃) | Vf(V) | THERMOCOUPLE (℃) | Vf(V) | THERMOCOUPLE (℃) | Vf(V) |
| 38.2 | 8.5967 | 38.2 | 13.9838 | 38.2 | 13.7881 | 38.2 | 13.7014 |
| 49.2 | 8.4916 | 49.2 | 13.8354 | 49.2 | 13.6397 | 49.3 | 13.5588 |
| 59.4 | 8.3989 | 59.3 | 13.6989 | 59.4 | 13.4996 | 59.3 | 13.4352 |
| 69.7 | 8.3078 | 69.7 | 13.5588 | 69.6 | 13.3577 | 69.7 | 13.3033 |
| 80.3 | 8.2142 | 80.2 | 13.4163 | 80.3 | 13.2103 | 80.2 | 13.1716 |
| 90.4 | 8.1252 | 90.4 | 13.2779 | 90.4 | 13.0732 | 90.4 | 13.049 |
| $y=11.508x^2-303.51x+1796.8$ | | $y=-0.4247x^2-62.383x+993.6$ | | $y=-0.476x^2-60.047x+956.7$ | | $y=3.0249x^2-160.82x+1673.8$ | |

(1) Red
$y = 11.508x^2 - 303.51x + 1796.8$
$R^2 = 1$ (2) Green
$y = -0.4247x^2 - 62.383x + 993.6$
$R^2 = 1$ (3) Blue
$y = -0.476x^2 - 60.047x + 956.7$
$R^2 = 1$ (4) BY
$y = 3.0249x^2 - 160.82x + 1673.8$
$R^2 = 1$

BRIGHTNESS CONTROL APPARATUS, DISPLAY APPARATUS AND LIGHTING APPARATUS

CROSS-REFERENCE TO RELATED APPLICATION

The present application is based upon and claims the benefit of priority of Japanese Patent Application No. 2010-268153, filed on Dec. 1, 2010, the entire contents of which are incorporated herein by reference.

BACKGROUND OF THE INVENTION

1. Field of the Invention

The present invention relates to a brightness control apparatus, a display apparatus including the brightness control apparatus, and a lighting apparatus including the brightness control apparatus. More particularly, the present invention relates to a brightness control apparatus, a display apparatus including the brightness control apparatus, and a lighting apparatus including the brightness control apparatus for performing stable brightness control for backlights of the display apparatus and the lighting apparatus.

2. Description of the Related Art

In technical fields of various display apparatuses for displaying pictures or images, enhancement of image quality and improvement of power consumption and the like are being studied. Also, as recent display apparatuses, especially, liquid crystal displays (LCD) are commonly used.

In general, the LCD is configured to include an output panel for displaying an image using light and a backlight unit for emitting light. The backlight unit is designed mainly for the purpose of providing light evenly to an effective display area of the output panel on which the image is displayed.

Also, control apparatuses (for example, contents analyzer) for controlling the backlight unit are known. Generally, in these control apparatuses, backlight control is performed by using simple APL (Average Picture Level (average brightness level)) detection. Also, it is known that brightness control is performed linearly using APL information of an image signal when controlling brightness of backlights of the LCD panel.

In recent years, techniques for using plural light-emitting elements such as LED (Light Emitting Diode) as backlight or lighting are attracting attention. In the LEDs, LED-by-LED variation occurs. As the variation of LEDs, it is known that there are variations in a steady state, variation due to temperature change and variation due to temporal change and the like. The variations in a steady state include manufacturing variations at a component level. It is left up to user's decision whether to select a product or to use a production without selection, which largely influences the price of the product. Several techniques for the variations are disclosed (refer to patent documents 1: Japanese Laid-open patent application No. 2006-31977 and patent documents 2:Japanese Laid-open patent application No. 11-305198, for example).

The patent document 1 discloses a backlight apparatus including a lighting unit having plural light-emitting diodes, a driving unit for driving light-emitting diodes, and a temperature detection unit. The driving unit adjusts currents supplied for the light-emitting diodes according to a temperature of the lighting unit. The patent document 2 discloses a liquid crystal display apparatus for driving LED backlights using a constant-current circuit.

As mentioned above, there are plural types of LED variations such as the steady-state variation, temperature-change variation, and temporal-change variation. Therefore, it is necessary to perform brightness control against brightness variation using a proper method for each of the types. However, such a technique has not been proposed.

SUMMARY OF THE INVENTION

Accordingly, an object of the present invention is to provide a brightness control apparatus, a display apparatus including the brightness control apparatus, and a lighting apparatus including the brightness control apparatus for performing stable brightness control for backlights of the display apparatus and the lighting apparatus.

According to an embodiment of the present invention, there is provided a brightness control apparatus configured to perform brightness control for backlights formed by plural light-emitting elements for a display screen, including:

a pulse control signal transmit unit configured to transmit a pulse control signal for performing driving control on the plural light-emitting elements based on a preset brightness control signal;

a voltage control unit configured to control a voltage of the pulse control signal obtained by the pulse control signal transmit unit for each set of light-emitting elements of the same color so as to correct brightness variation in a regular state for the plural light-emitting elements; and a current control unit configured to control a current for each of the plural light-emitting elements based on a voltage value obtained by the voltage control unit so as to correct brightness variation due to temperature change or temporal change.

According to an embodiment of the present invention, stable brightness control for backlights and a lighting apparatus can be performed.

Other objects and further features of the present invention will be apparent from the following detailed description when read in conjunction with the accompanying drawings.

BRIEF DESCRIPTION OF THE DRAWINGS

FIG. 4 is a diagram for explaining a concrete example of calculating a temperature correction value;

FIGS. 5A-5C are diagrams for explaining concrete examples in which correction values are calculated by using functions;

DESCRIPTION OF THE PREFERRED EMBODIMENTS

Figure 1:
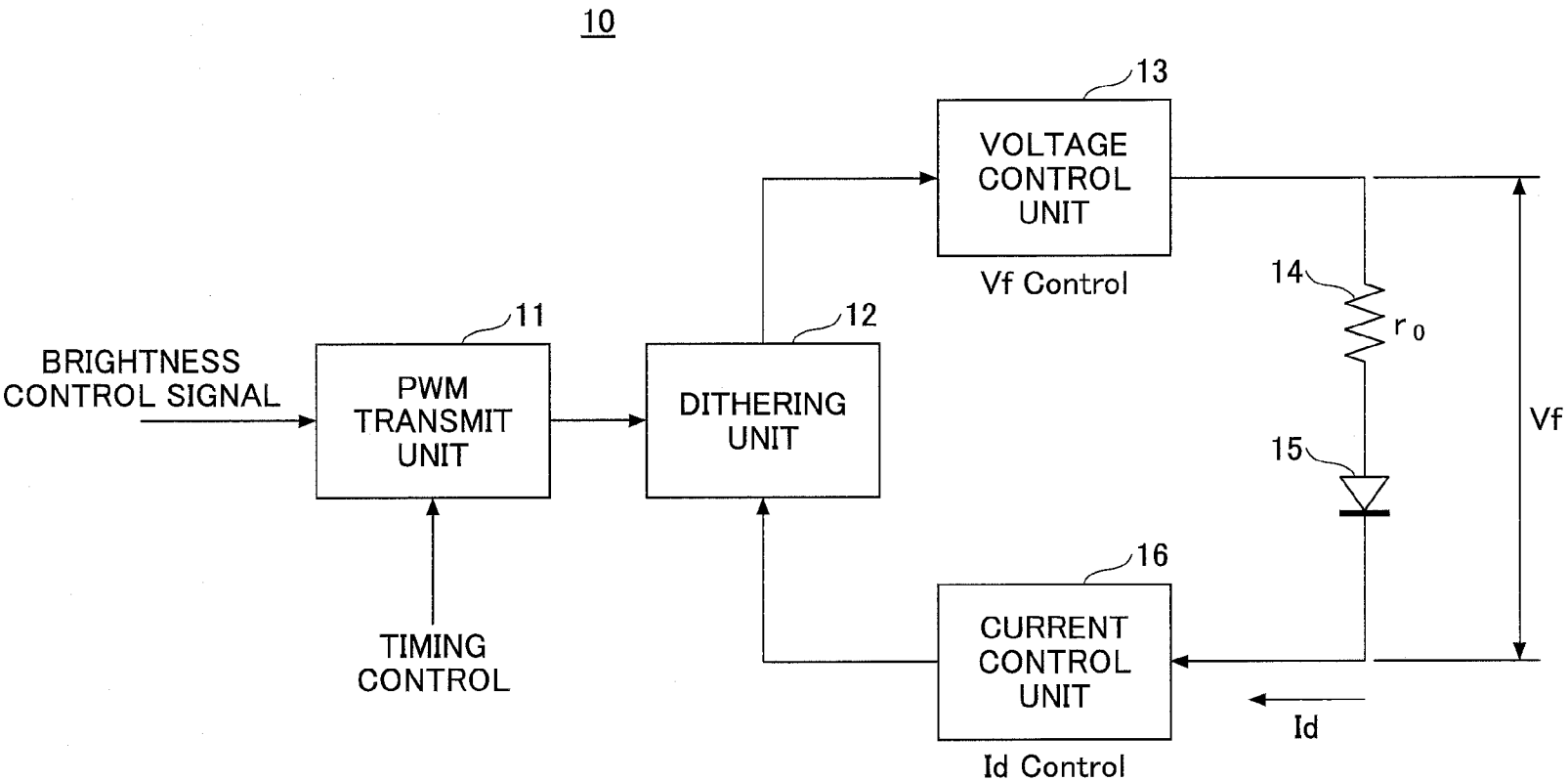
FIG. 1 is a diagram showing an example of brightness control by correcting brightness variation according to an embodiment.

Preferred embodiments are described below with reference to the accompanying drawings. In the present embodiments, the meaning of "image signal" includes both of a signal of a moving picture (moving image) and a signal of a still image.

<Outline of Embodiment>

In an embodiment, a brightness control apparatus (10) configured to perform brightness control for backlights formed by plural light-emitting elements (15) for a display screen is provided. The brightness control apparatus (10) includes:

a pulse control signal transmit unit (11) configured to transmit a pulse control signal for performing driving control on the plural light-emitting elements based on a preset brightness control signal;

a voltage control unit (13) configured to control a voltage of the pulse control signal obtained by the pulse control signal transmit unit for each set of light-emitting elements of the same color so as to correct brightness variation in a regular state for the plural light-emitting elements; and a current control unit (16) configured to control a current for each of the plural light-emitting elements based on a voltage value obtained by the voltage control unit so as to correct brightness variation due to temperature change or temporal change.

The above reference symbols are merely examples, and embodiments described herein are not limited by the reference symbols.

In an embodiment, brightness control is performed for eliminating brightness variation between light-emitting elements (LEDs, for example) that are used as backlights of a display apparatus such as a TV, or as a lighting apparatus. More particularly, in an embodiment, correction is performed for each of brightness variation in a steady state, brightness variation due to temperature change and brightness variation due to temporal change, in a predetermined order. Hereinafter, brightness variation in a steady state may be referred to as steady-state variation, the brightness variation due to temperature change may be referred to as temperature-change variation, and the brightness variation due to temporal change may be referred to as temporal-change variation.

For example, for the steady-state variation, driver voltage of PWM (Pulse Width Modulation) is automatically corrected. For the temperature-change variation, a current difference corresponding to temperature change that is fed-back is detected and compensated. For the temporal-change variation, a current corresponding to variation due to passage of time is detected and compensated.

Accordingly, even when plural light-emitting elements are used for backlights or a lighting apparatus or the like, it is not necessary to select light-emitting elements, so that the cost can be reduced. Also, brightness and white balance that are always stable can be obtained.

In the following, embodiments of a brightness control apparatus, a display apparatus including the brightness control apparatus, and a lighting apparatus including the brightness control apparatus for realizing the above-mentioned features are described. In the following examples, an LCD is used as an example of the display unit, and an LED is used as an example of the light-emitting element. But, the present invention is not limited to the LCD and the LED as the display unit and the light-emitting element respectively.

Also, in the following example, brightness control is described mainly in a case where an image signal is output to a display unit. But, the embodiments disclosed herein are not limited to such a case, and can be applied to various cases.

<Brightness Control by Brightness Variation Correction>

First, an example of brightness control by correcting brightness variation is described with reference to drawings. FIG. 1 is a diagram showing an example of brightness control by brightness variation correction. FIG. 1 shows an outline configuration of a part that performs brightness control in the brightness control apparatus 10.

The brightness control apparatus 10 shown in FIG. 1 includes a PWM transmit unit 11 as a pulse signal transmit unit, a dithering unit 12, a voltage control unit 13, a resistance unit 14 as a current adjusting unit, an LED 15 that is a light-emitting element, and a current control unit 16.

The PWM transmit unit 11 generates a PMW control signal (pulse control signal) by performing pulse width modulation based on PWM and the like. The brightness control signal includes a brightness control signal set for each image frame of an image signal displayed on a screen, a preset brightness control signal for backlights, for example. Also, the PWM transmit unit 11 transmits (outputs) a PWM control signal generated at input timing to the dithering unit 12.

As to the pulse-width modulated control signal, the control signal is output at timing corresponding to light-emitting timing of each of plural LEDs that are targets of control. That is, the PWM transmit unit 11 controls output timing of the control signals for different light-emitting elements. Concrete timing control in the PWM transmit unit 11 is described later.

The dithering unit 12 performs dithering processing on an input signal based on the PWM control signal obtained from the PWM transmit unit 11 or a signal on which current control has been performed obtained from the current control unit 16. The dithering processing is performed in order to smooth the duty change of PWM, that is, to smooth change of a ratio of ON and OFF of pulse widths (ratio of lighting time with respect to shutoff time of backlight).

The dithering unit 12 may perform dithering processing for a predetermined period in order to eliminate flicker of the image signal, for example. The dithering unit 12 outputs a brightness control signal in which duty change is smoothed to the voltage control unit 13.

As an example of duty change in the present embodiment, an average value of brightness is detected from an input image signal, and light-source brightness is increased when the detected average value of the brightness is higher than a predetermined threshold, and, light-source brightness is decreased when the detected average value of the brightness is lower than a predetermined threshold, for example. However, embodiments described herein are not limited to this method. Also, in the present embodiment, the dithering unit 12 adjusts the waveform of the brightness control signal such that the duty change is smoothed. Details on the dithering unit 12 are described later.

The voltage control unit 13 performs voltage control on the input brightness control signal so as to even out brightness variation in a steady state. Also, the voltage control unit 13 outputs the control signal in which steady-state brightness variation is evened out to the resistance unit 14. Concrete control details of the voltage control unit 13 are described later.

The resistance unit 14 includes a resistance $r_0$ for adjusting a current value supplied for each LED connected to the resistance. That is, the resistance unit 14 adjusts a current value with respect to the voltage Vf between the resistance unit 14 and the LED 15. As a result, the LED 15 can be turned on while adjusting the brightness level.

The LED 15 is a light-emitting element that emits light at the above-mentioned predetermined timing as backlight of the LCD panel and the like. In the case when the LED 15 is used as a backlight, white LEDs may be arranged in order to emit white illuminating light. As another type of LED backlight, LEDs of three colors of R (red), G (green) and B (blue) may be arranged so that the three colors are mixed to emit white light. That is, although only one LED 15 is shown in the example shown in FIG. 1, the embodiments described herein are not limited to the configuration. For example, plural LEDs may be connected serially or in parallel.

Also, as to the white LED, there are several types. In one type of the white LED, fluorescent material is combined with a short-wavelength LED to obtain white light. In another type, fluorescent material is combined with a blue LED to obtain white light. Also, there is a type in which yellow fluorescent material is combined with a blue LED to obtain white light.

Current values that need to be supplied vary according to types of LEDs. Therefore, in the present embodiment, the value of the resistance $r_0$ is adjusted and set according to the type of the connected LED, Normally, plural LEDs are arranged when the LEDs are used for backlights of an LCD panel or for a lighting apparatus or the like. In such a case, the resistance needs to be adjusted in consideration of the color and placement of each of the LEDs (for example, combination of LEDs that are connected serially or parallely).

The current control unit 16 performs current control for the current value Id output from the LED 15 so as to perform correction for brightness variation due to temperature change, and correction for brightness variation due to temporal change in order to even out the brightness variations due to temperature change and the like. Details of control by the current control unit 16 are described later.

In the above-mentioned brightness control apparatus 10, even though processing of the dithering unit 12 is not performed, the brightness control apparatus 10 can correct the brightness variation among LEDs in the regular state, brightness variation among LEDs due to temperature change, and brightness variation among LEDs due to temporal change. Accordingly, stable brightness control can be performed.

Next, brightness variation control processing in each of the voltage control unit 13 and the current control unit 16 is described more concretely.

<Variation Correction in Steady State for LED Brightness in the Voltage Control Unit 13>

Figure 2B:
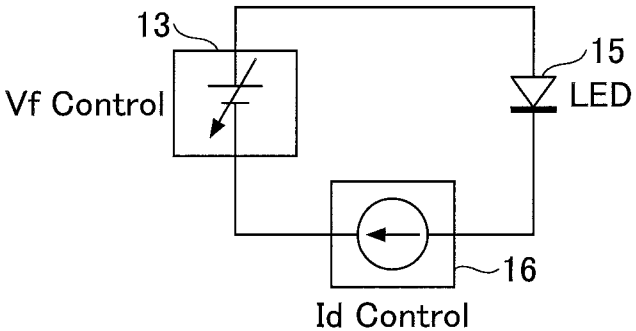
FIGS. 2A-2C are diagrams showing an example of brightness variation correction in a steady state according to an embodiment.
Figure 2A:
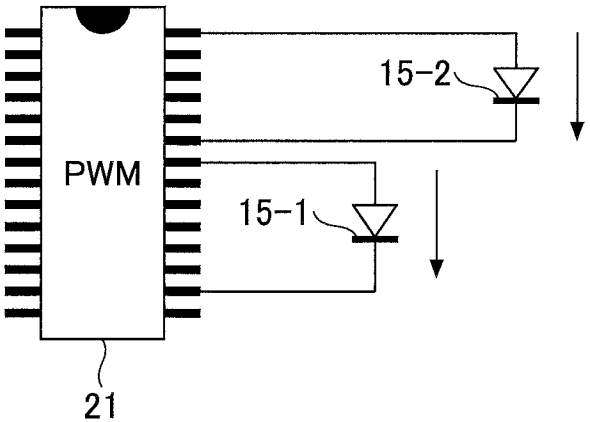
Figure 2C:
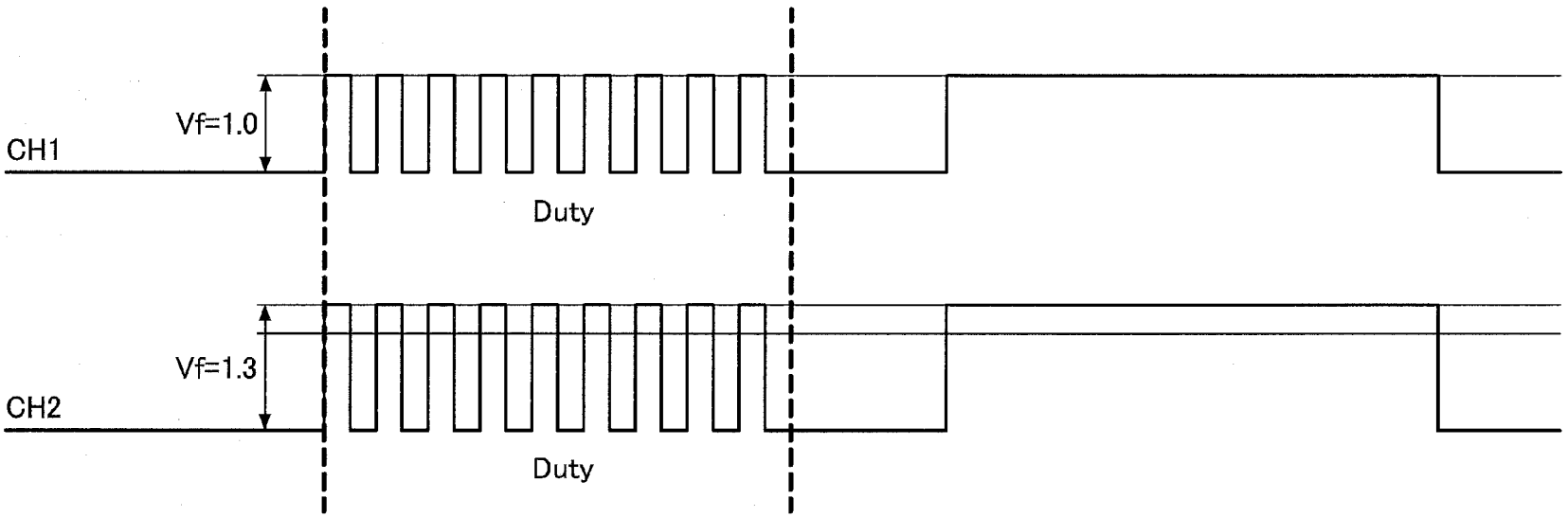

FIGS. 2A-2C are diagrams showing an example of brightness variation correction in a steady state. In the example shown in FIGS. 2A-2C, the driver voltage in the driver IC (PWM) 21 is automatically corrected so that the brightness variation in a steady state is corrected.

FIG. 2A shows a configuration in which two LEDs 15-1 and 15-2 are connected to one driver IC 21, and brightness control is performed for each of the two LEDs 15-1 and 15-2 to cause the LEDs to operate properly. The embodiments described herein are not limited to this configuration. For example, one or equal to or more than three LEDs may be connected to one driver IC 21 so that brightness control may be performed. Further, in the example shown in FIG. 2A, although the LED 15-1 and the LED 15-2 are light-emitting elements that emit light of different colors, the present invention is not limited to that configuration. For example, brightness control may be performed for plural LEDs that emit light of the same color.

In the present embodiment, the driver IC 21 shown in FIG. 2A includes functions of the voltage control unit 13 and the current control unit 16 as shown in FIG. 2B. But, the present invention is not limited to the configuration. For example, the driver IC 21 may include the function of the dithering unit 12 as shown in FIG. 1.

In the connection state of LEDs shown in FIG. 2A, in the case when brightness variation correction in a steady state is performed, it is assumed that voltage values of PWM control signals CH1 and CH2 for the LEDs 15-1 and 15-2 respectively from the driver IC 21 are as shown in FIG. 2C. That is, as shown in FIG. 2C, the voltage Vf is 1.0V in CH1, and the voltage Vf is 1.3V in CH2.

In this case, the driver IC 21 performs voltage control such that the signals of CH1 and CH2 become target values that are preset. That is, the driver IC 21 performs correction for one or both of the signals of CH1 and CH2 such that each of the voltages of CH1 and CH2 become a normal value in order to eliminate brightness variation. A range of voltage values that can be corrected in the steady-state variation correction is about ±0.1V with respect to an input value.

<Temperature-Change Variation Correction and Temporal-Change Variation Correction for LED Brightness in the Current Control Unit 16>

Figure 3:
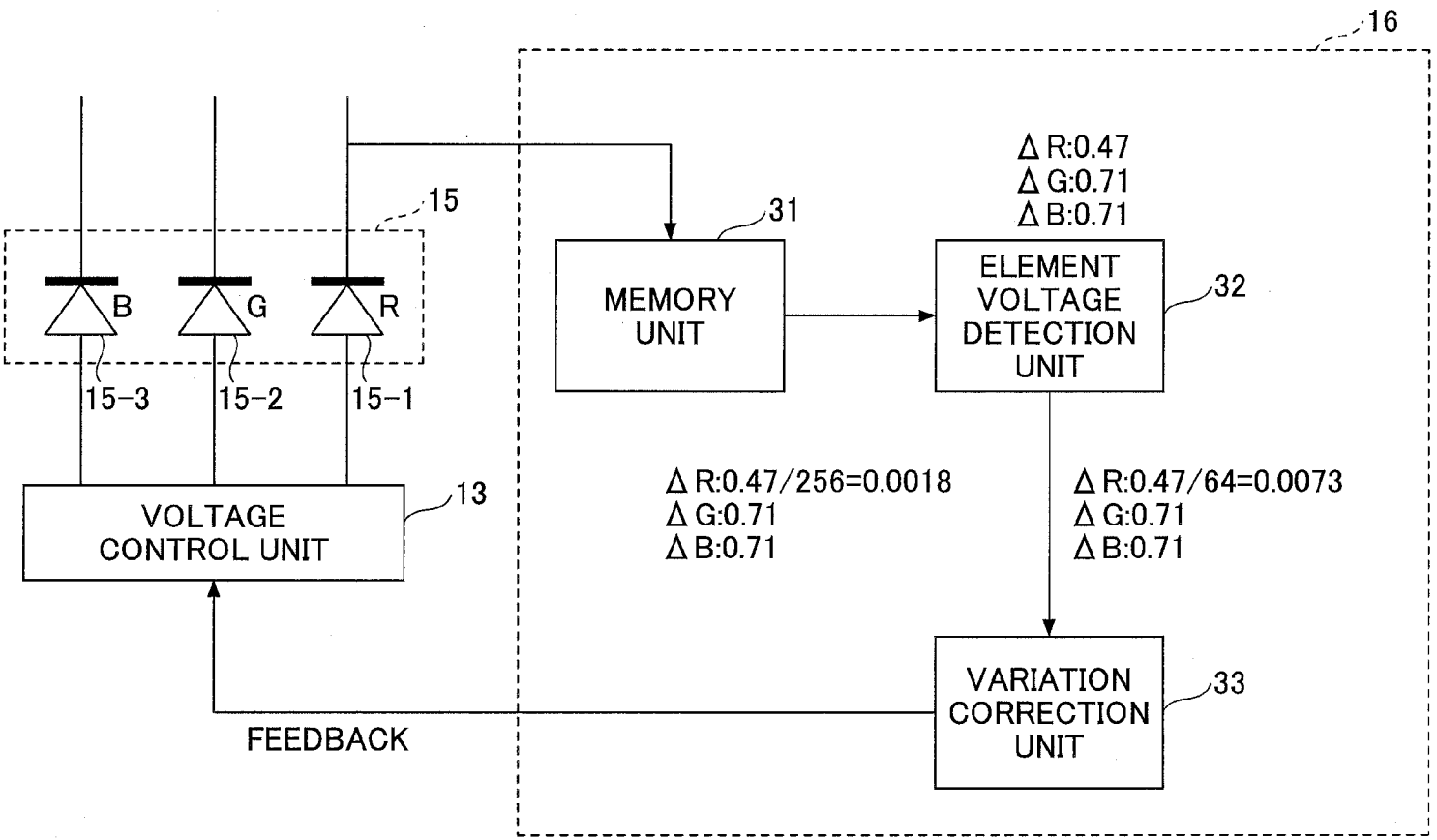
FIG. 3 is a diagram showing an example for correcting brightness variation due to temperature change according to an embodiment.

Next, temperature-change variation correction and temporal-change variation correction for LED brightness in the current control unit 16 are described with reference to figures in detail. FIG. 3 is a diagram showing an example of a configuration for correcting brightness variation due to temperature change. In the example shown in FIG. 3, a current difference due to temperature change that is fed back is detected so that the detection result is corrected to a preset proper value. In the same way, as to temporal-change variation correction, a current difference corresponding to change due to time passage is detected so that the detection result is corrected to a preset proper value. Accordingly, variation correction is performed. The "temporal change" means change due to element deterioration and the like caused by the passage of time.

The example of FIG. 3 shows a detailed configuration example of the current control unit 16 compared to the configuration shown in FIG. 2B. In the example of FIG. 3, temperature-change variation correction is performed for three LEDs 15-1, 15-2 and 15-3. The LEDs 15-1, 15-2 and 15-3 correspond to light-emitting elements of red, green and blue respectively. But, the present invention is not limited to this configuration.

The current control unit 16 shown in FIG. 3 includes a memory unit 31 as a buffer, an element voltage detection unit 32, and a variation correction unit 33. In the present embodiment, a correction value is set for one of different colors of the plural LEDs placed as backlights, so that variation correction processing is performed for the color and the other colors of LEDs using the set correction value as a reference. It is known that temperature-change variation in red is the largest among the three colors of LEDs. Therefore, in the present embodiment, temperature change (change amount) for the red LED 15-1 is measured, and variation correction is performed for the measurement result. Accordingly, valuation due to temperature change is avoided, so that brightness control with high accuracy can be realized.

As shown in FIG. 3, the current control unit 16 measures a voltage value RedVf for the red LED 15-1 in the plural LEDs 15-1~15-3 that are control targets, and stores the voltage value RedVf in the memory unit 31. In the memory unit 31, voltage values measured at predetermined timing (at predetermined time intervals, for example) are sequentially stored with measurement time information or storing time information. The memory unit 31 has at least a capacity for storing information corresponding to a necessary number of times of measurements in the present embodiment.

The element voltage detection unit 32 obtains measurement values that are measured at different times in the measured information of plural times of measurements stored in the memory unit 31, so as to detect a current difference corresponding to temperature-change by using a difference between obtained voltage values and a resistance value of a preset resistance (current adjustment unit). More particularly, the element voltage detection unit 32 performs analog-digital conversion (ADC) on the voltage value Vf supplied to the LED 15-1, and obtains temperature-change variation correction values corresponding to R, G and B respectively by using a current difference obtained from a voltage different that is the result of the analog-digital conversion. That is, in the present embodiment, the current difference obtained in the above-mentioned way is considered to be brightness variation due to temperature change or temporal change, so that brightness variation correction due to temperature change or temporal change is performed by controlling the voltage.

In the example shown in the FIG. 3, for example, it is assumed that voltage differences ΔR, ΔG and ΔB of R, G and B are ΔR=0.47, ΔG=0.71 and ΔB=0.71 respectively. In the present embodiment, the correction value is calculated according to the preset number of bits that can be represented in one pixel to be displayed, for example. The calculation method for correction in the present embodiment is described later.

The variation correction unit 33 generates control signals for LEDs 15-1~15-3 based on the correction value obtained by the element voltage detection unit 32. That is, the variation correction unit 33 generates control signals for performing feedback control for the green LED 15-2 and the blue LED 15-3 based on information of variation correction for the red LED 15-1. In addition, the variation correction unit 33 outputs generated control signals to each of the LEDs 15-1~15-3 via the voltage control unit 13. Accordingly, variations due to temperature change or temporal change are corrected so that accurate brightness control by backlights can be performed.

<Example of Calculation of a Correction Value by Temperature-Change Variation Correction>

Figures 5B, 5C:
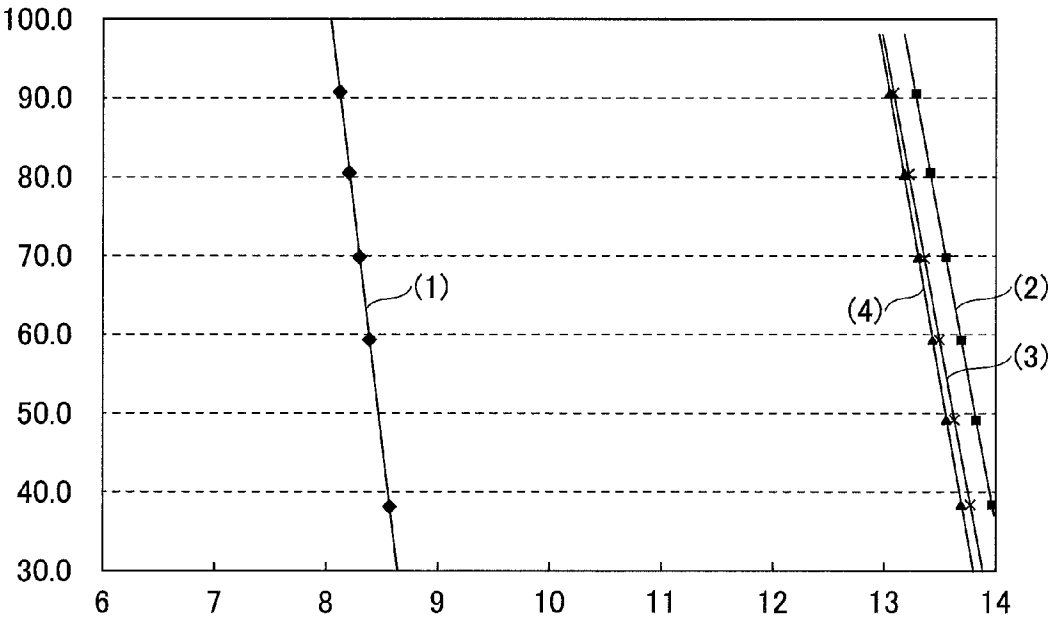

An example of calculation of a correction value by temperature-change variation correction is described with reference to figures. FIG. 4 is a diagram (showing LED spread and temperature drift) for explaining a concrete example for calculating a correction value by temperature-change variation correction. FIGS. 5A-5C are diagrams for explaining concrete examples in which correction values are calculated by using a function.

As shown in FIG. 4, considering LED spread and temperature drift, when a thermocouple is 50° C., there are voltage differences of R=about 0.47V, G=about 0.71V and B=about 0.71V for R, G and B respectively. Thus, voltage differences are R=about 0.0094V, G=about 0.0142V and B=about 0.0142V when being converted to 1° C. unit.

As mentioned above, in the present embodiment, a correction value is set for one of different colors of the plural LEDs placed as backlights, so that variation correction processing is performed for the color and the other colors of LEDs using the set correction value as a reference. Therefore, a temperature difference of the red LED is corrected first.

In the present embodiment, a correction value varies according to a data amount used for brightness control for one pixel. As shown in FIG. 4, in the detection of the voltage value Vf, in the case when performing analog-digital conversion using 8 bits (in the case of 8 bit ADC), the correction value becomes ΔR:0.47/256=0.0018.

Similarly, in the case of 7 bit ADC, the correction value becomes ΔR:0.47/128=0.0036. In the case of a 6 bit ADC, the correction value becomes ΔR:0.47/64=0.0073.

Each of the correction values for other colors of LEDs can be calculated based on the above-mentioned correction value. Alternatively, a function and the like may be defined for calculating each of the correction values for other colors beforehand, so that the correction value may be calculated as necessary by substituting a value into the function as shown in FIGS. 5A-5C, for example.

FIG. 5A shows examples of values of thermocouples (° C.) and voltages Vf (V) for the temperatures for each of (1)Red, (2)Green, (3)Blue and (4)BY. In FIG. 5A, "BY" means a white LED in which yellow fluorescence substance is added to a blue LED.

FIG. 5B shows an example of a graph of functions determined by the results shown in FIG. 5A.

Voltage differences of three colors (R, G and B) shown in FIG. 5A are ΔR: about 0.47V, ΔG: about 0.71V and ΔB: about 0.71V respectively as mentioned above. In the case of 8 bit ADC, the correction value of AR is 0.47/256=about 0.0018.

In the case where normal ADC is used, assuming that 1V corresponds to 8 bits, 1 bit corresponds to $1/256$=0.0039V. Therefore, the function for (1)Red is $y=11.508x^2-303.51x+1796.8$, the function for (2)Green is $y=-0.4247x^2-62.383x+993.6$, the function for (3)Blue is $y=-0.476x^2-60.047x+956.7$, and the function for (4)BY is $y=3.0249x^2-160.82x+1673.8$. Temperature-change variation correction can be performed for each color of LEDs by using corresponding one of the equations.

<Dithering Unit 12>

In the following, the above-mentioned dithering unit 12 is described in detail. In a control method in which LEDs (used for backlights of an LCD panel or lighting apparatus and the like) are driven by PWM switching drive so as to realize brightness change, side effects in which flicker due to switching operation may be felt by a viewer.

Therefore, in the present embodiment, in order to soften the PWM switching operation, dithering operations are multiplexed, so that smooth and natural brightness gray dimming can be realized. Accordingly, flicker can be largely reduced.

As dithering methods in the dithering unit 12, there are methods of random dithering, pattern dithering and magic dithering and the like. In any dithering method, the same effect can be obtained.

Figure 6A:
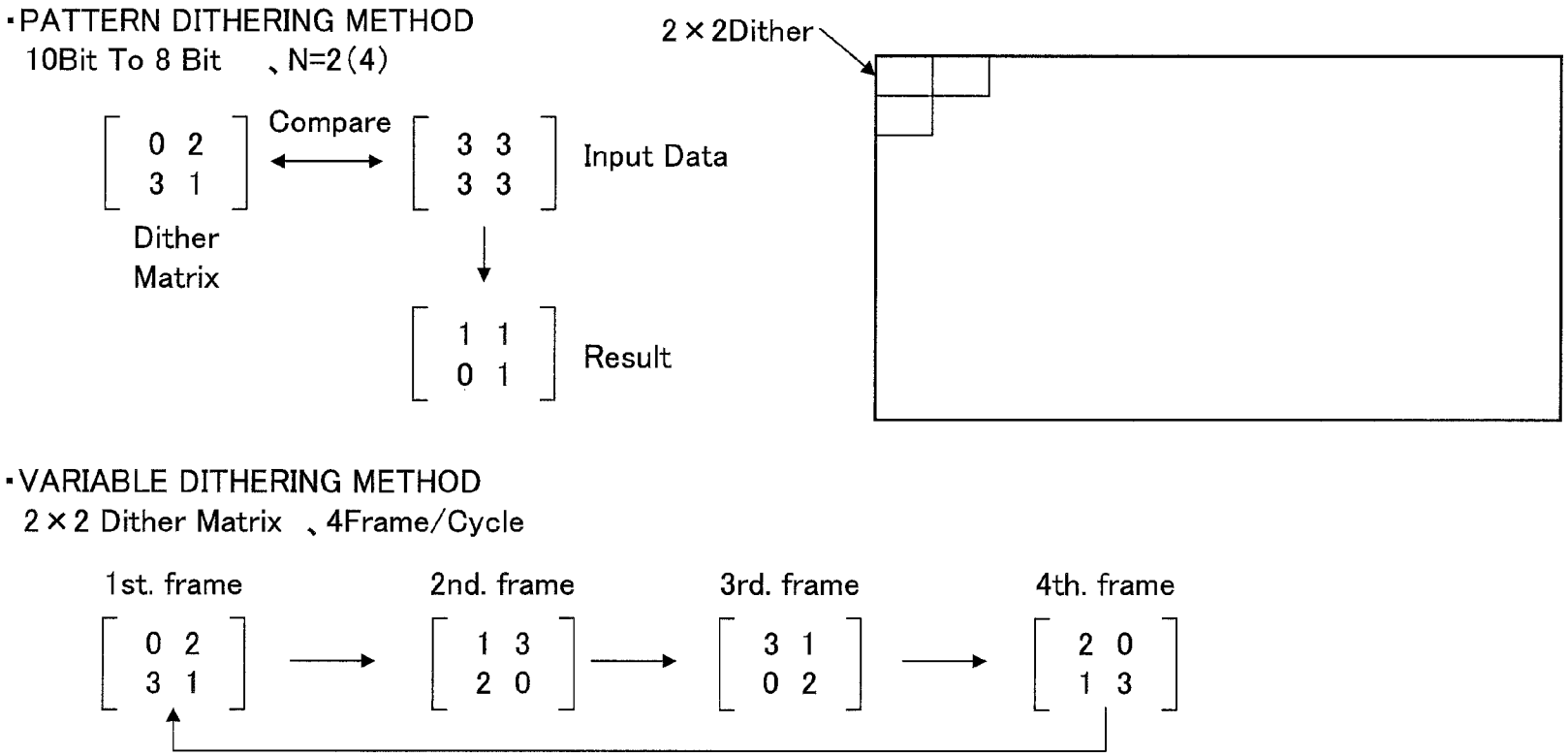
FIGS. 6A-6C are diagrams for explaining dithering according to an embodiment.
Figure 6B:
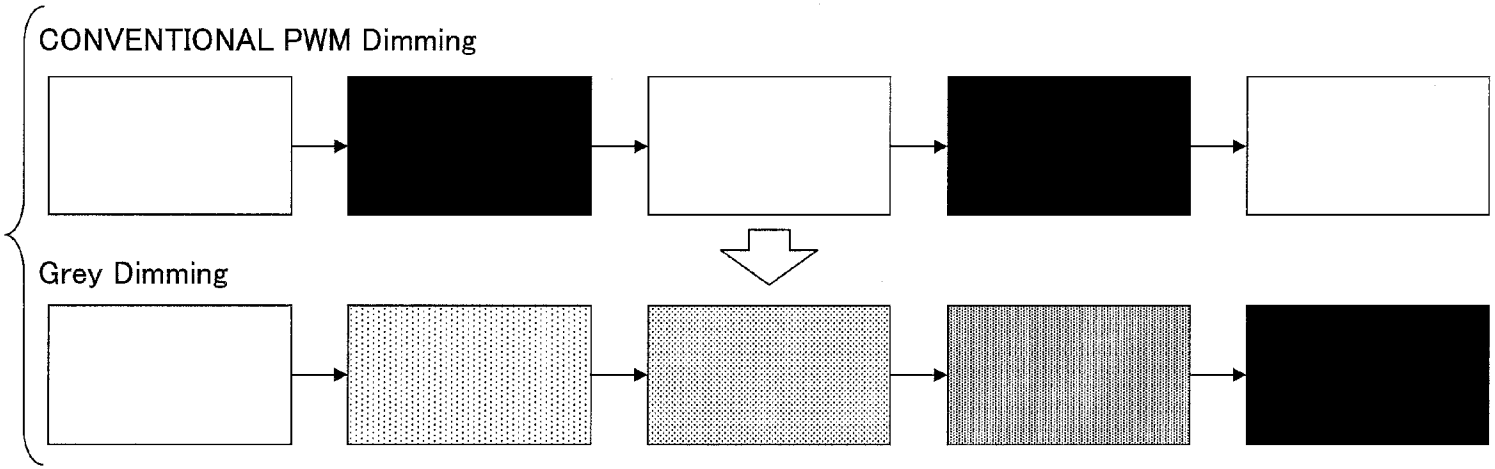
Figure 6C:
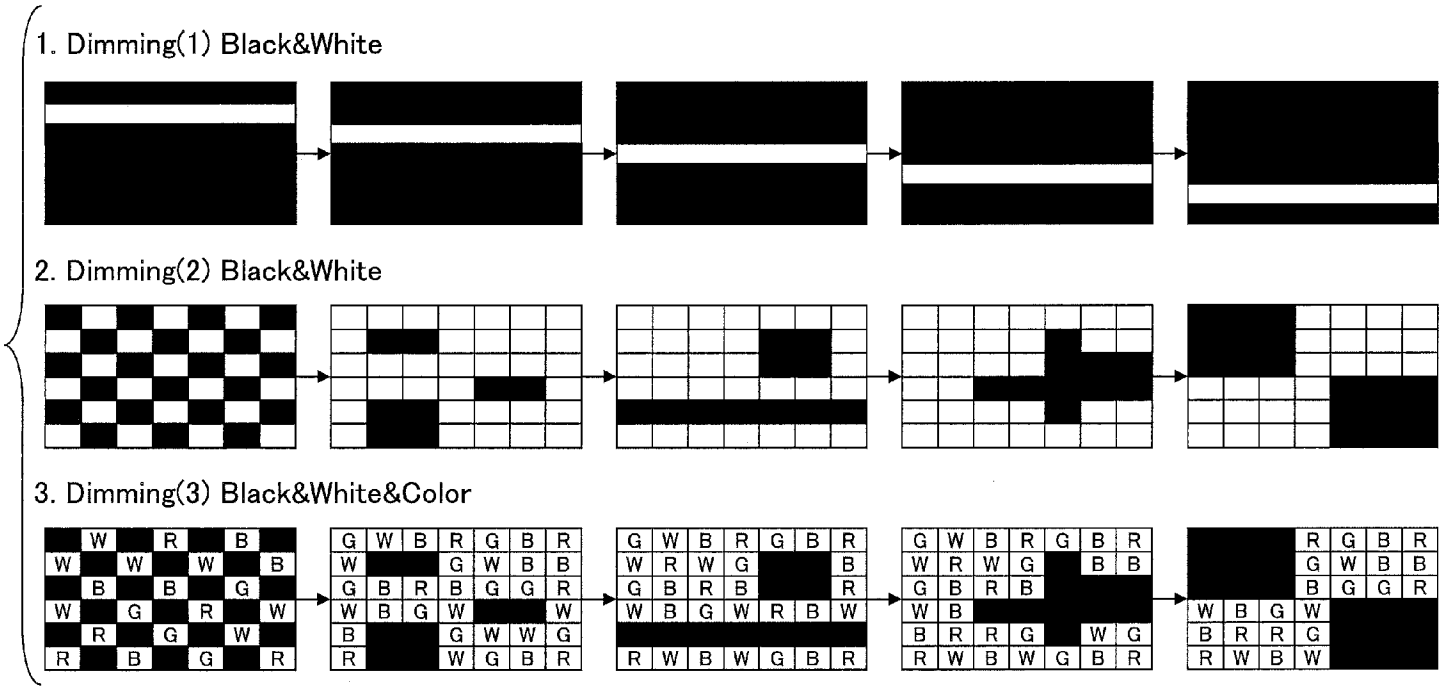

FIGS. 6A-6C are diagrams for explaining dithering in the present embodiment. FIG. 6A shows examples of a pattern dithering method and a variable dithering method.

As shown in FIG. 6A, in the pattern dithering method, a preset dither matrix (2×2 bits, for example) is compared with input data. Then, based on the comparison result, dithering is performed so as to eliminate flicker.

In the variable dithering, four image frames are set to be one cycle for each dithering matrix of 2×2, so that each value of the matrix is replaced in a predetermined order to perform dithering.

FIG. 6B is a diagram for describing 0 dimensional dimming. The 0 dimensional dimming means operation in which brightness of the whole screen is controlled based on white, black, grey and the like.

As shown in FIG. 6B, according to the conventional PWM dimming method, brightness of PWM is controlled by alternately outputting a white frame and a black frame in order to control brightness of backlights. In this case, flicker occurs. Therefore, in the present embodiment, when performing brightness control from a white frame to a black frame, for example, one or plural gray frames (neutral color frames)

having different brightness levels that are different from the white frame and the black frame is/are inserted between the white and black frames.

Accordingly, flicker in PWM control can be eliminated, so that brightness gray dimming can be performed more smoothly in backlight brightness control. Also, by controlling brightness of the LED backlights using the dithering method of gray dimming, the image is felt natural in which abrupt brightness change is eliminated, so that natural image expression can be obtained. That is, high image quality can be provided.

It is preferable that values of brightness of the gay frames are adjusted such that the brightness gradually changes from white to black starting from the white frame to the black frame. Also, the number of neutral color frames to be inserted can be set arbitrarily.

FIG. 6C is a diagram for explaining a flexible dimming system. In the present embodiment, three types of dimming are shown.

More particularly, as shown in FIG. 6C (Dimming(1) (Black&White)), a white pixel line including plural pixels is inserted in a part of the black frame and the position of the white pixel line is moved, so that dimming processing is performed.

As shown in the part of Dimming(2) (Black&White), dimming processing may be performed by sequentially using a frame in which black parts of plural different pixel areas (preset areas) are inserted in the white frame.

In addition, as shown in the part of Dimming(3) (Black&White&Color), dimming processing may be also performed by randomly inserting colors of R, G, B and W into square parts of white pixels of a frame shown in Dimming (2).

By performing the flexible dimming processing as shown in FIG. 6C, dimming processing can be performed irrespective of LED backlight schemes.

<Timing Control in PWM Transmit Unit 11>

Figure 7A:
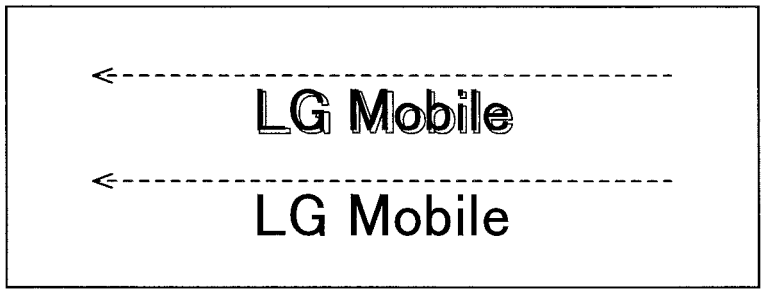
FIGS. 7A and 7B are diagrams for explaining PWM timing control.
Figure 7B:
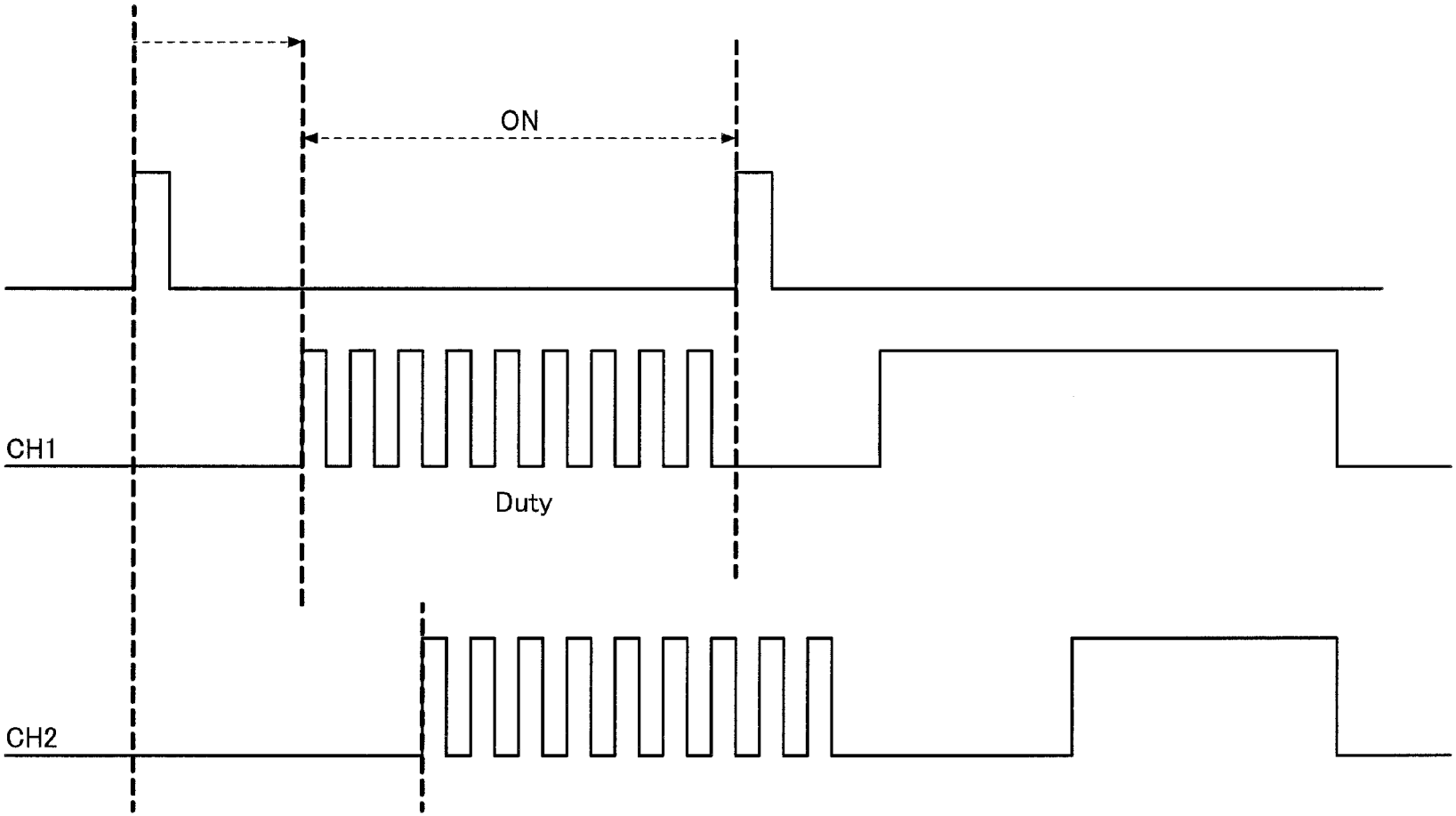

Next, timing control in the PWM transmit unit 11 is described with reference to figures. FIGS. 7A and 7B are diagrams for explaining PWM timing control.

Generally, since the response speed of the LCD panel and the like is slow, when displaying scroll characters moving at high speed on a screen, a problem may occur in which the characters ("LG Mobile", for example) are blurred so that the characters cannot be read clearly as shown in the upper side of FIG. 7A. For solving this problem, there was no effective measure other than increasing the response speed of the LCD panel. Also, in backlights using CCFL (Cold Cathode Fluorescent Lamp), since switching operation of CCFL is slow, backlights cannot be controlled in conjunction with operation of the LCD panel. Thus, the blurring feeling cannot be reduced.

In PWM control in the PWM transmit unit 11 in the present embodiment, switching operation of LED backlights are dynamically controlled in concert with the response speed of the LCD panel to be used. That is, in the present embodiment, the PWM transmit unit 11 performs LED backlight operation in concert with the response speed of the LCD panel. Accordingly, the blurring feeling for the characters and the like moving at high speed can be largely reduced.

More particularly, as shown in FIG. 7B, operation buffers are provided for the two LEDs of CH1 and CH2, so that control signals can be output at proper timing. In the example of FIG. 7B, in the control signal CH1, the switch is turned ON using an operation buffer and the like such that the control signal is output from a predetermined time for a predetermined period. Accordingly, as shown in the lower part of FIG. 7A, the display object moving fast such as scrolling characters can be displayed without blurring.

<Placement Example of LED Backlights>

Next, examples of arrangement of the LED backlights are described with reference to drawings. FIGS. 8A-8E are diagrams for explaining arrangement examples of LED backlights.

As shown in FIGS. 8A-8E, the LCD panel 41 that is a display unit is provided with element blocks 42 at predetermined positions, wherein a plurality of the above-mentioned plural LEDs are arranged at predetermined positions in each element block 42.

Figure 8A:
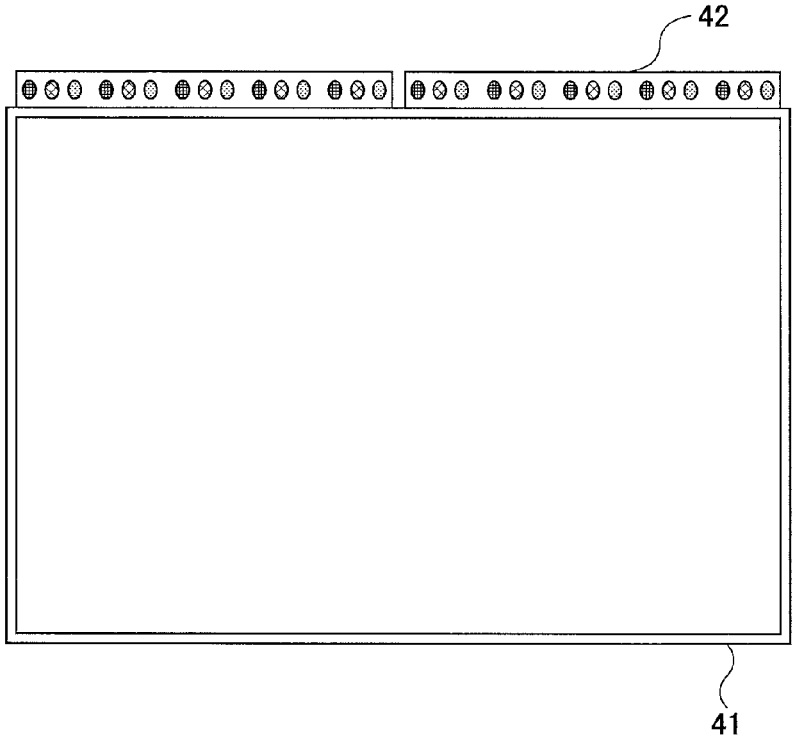
FIGS. 8A-8E are diagrams for explaining arrangement examples of LED backlights.
Figure 8B:
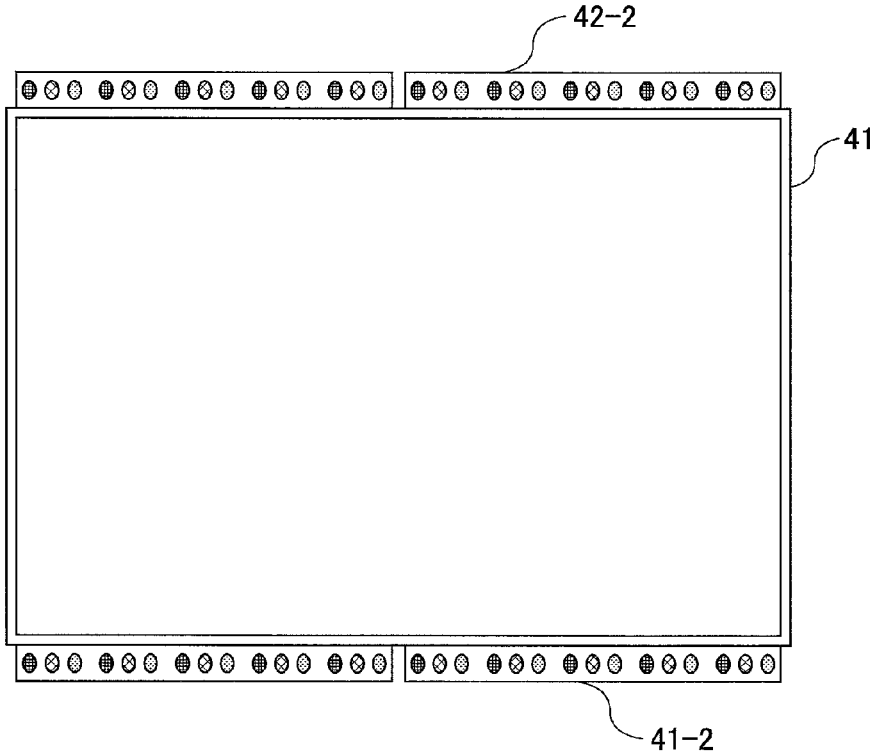
Figure 8C:
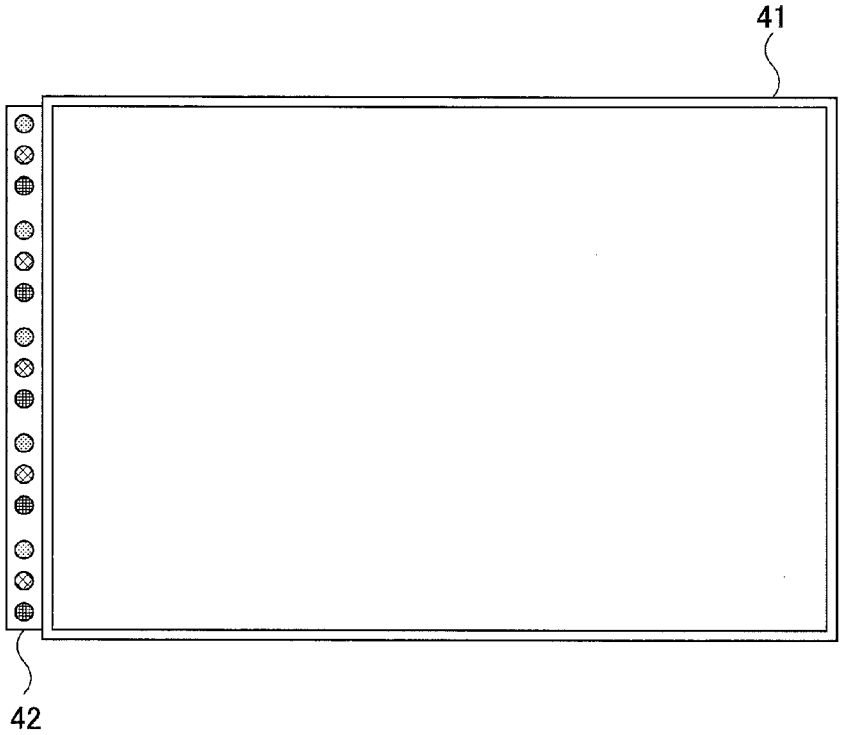
Figure 8D:
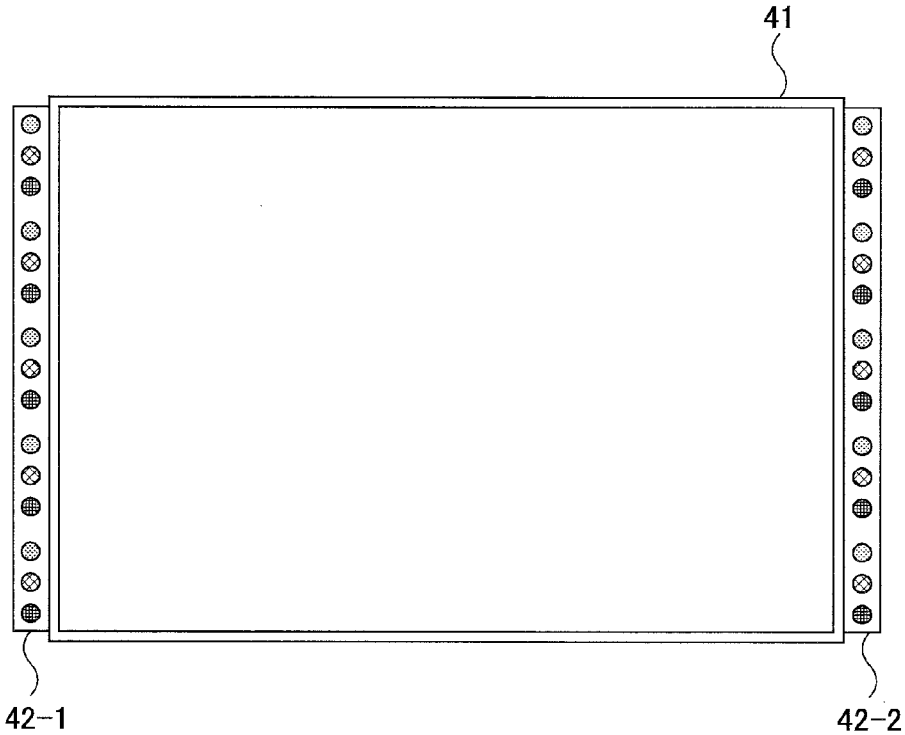
Figure 8E:
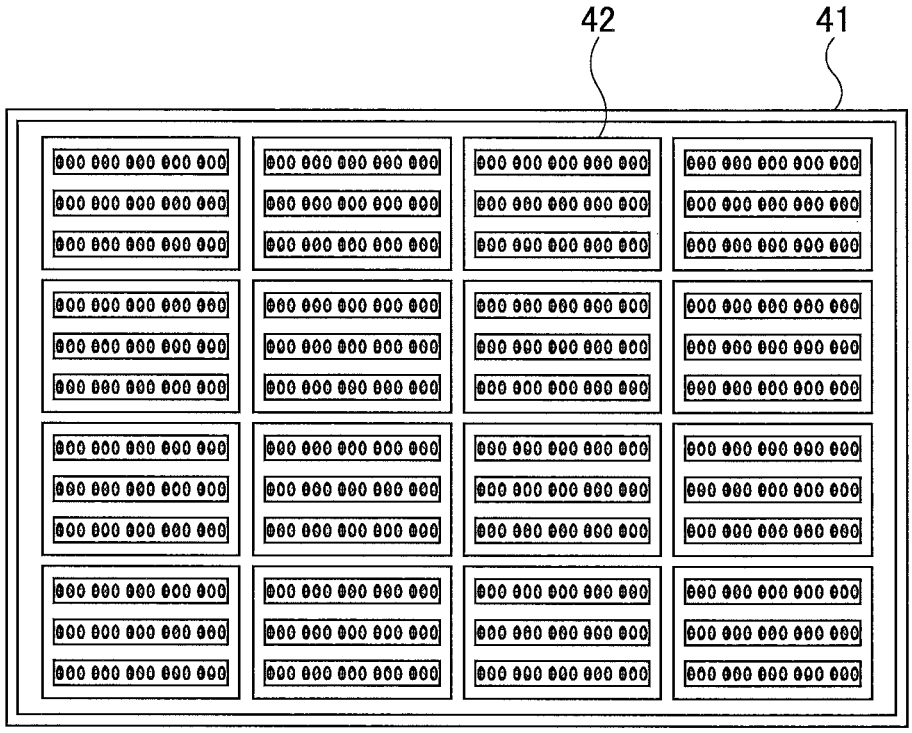

More specifically, in the example shown in FIG. 8A, an element block 42 is placed on the upper side of the LCD panel 41. In the example shown in FIG. 8B, element blocks 42-1 and 42-2 are placed on upper and lower sides of the LCD panel 41. In addition, as shown in the example of FIG. 8C, the element block 42 may be placed on one side (left or right, left in the case of FIG. 8C) of the LCD panel 41. Also, as shown in FIG. 8D, the element blocks 42-1 and 42-2 may be placed in both of the left and the right sides. Further, as shown in FIG. 8E, a predetermined number of element blocks 42 may be arranged on the backside of the LCD panel 41.

In the present invention, backlight placement is not limited to the above-mentioned examples. For example, the element blocks may be placed in upper and lower sides in addition to the left and right sides, and two or more of the above-mentioned examples may be combined. Brightness control is performed by the above-mentioned driver IC and the like for LEDs shown in FIGS. 8A-8E. Also, the element block 42 may be divided into blocks of a size according to at least one of detection results of APL (Average Picture Level) detection, brightness histogram detection, color histogram detection and frequency histogram detection obtained from an input image signal, for example. The present invention is not limited to this, and the element block 42 may be divided in units of predetermined blocks.

In the present embodiment, when a fault such as non-lighting occurs due to an end of life and the like in at least one of LEDs that are serially connected in the element block 42, bypass driving control may be performed such that the faulted LED does not affect the other LEDs.

<Block Information>

Figure 9A:
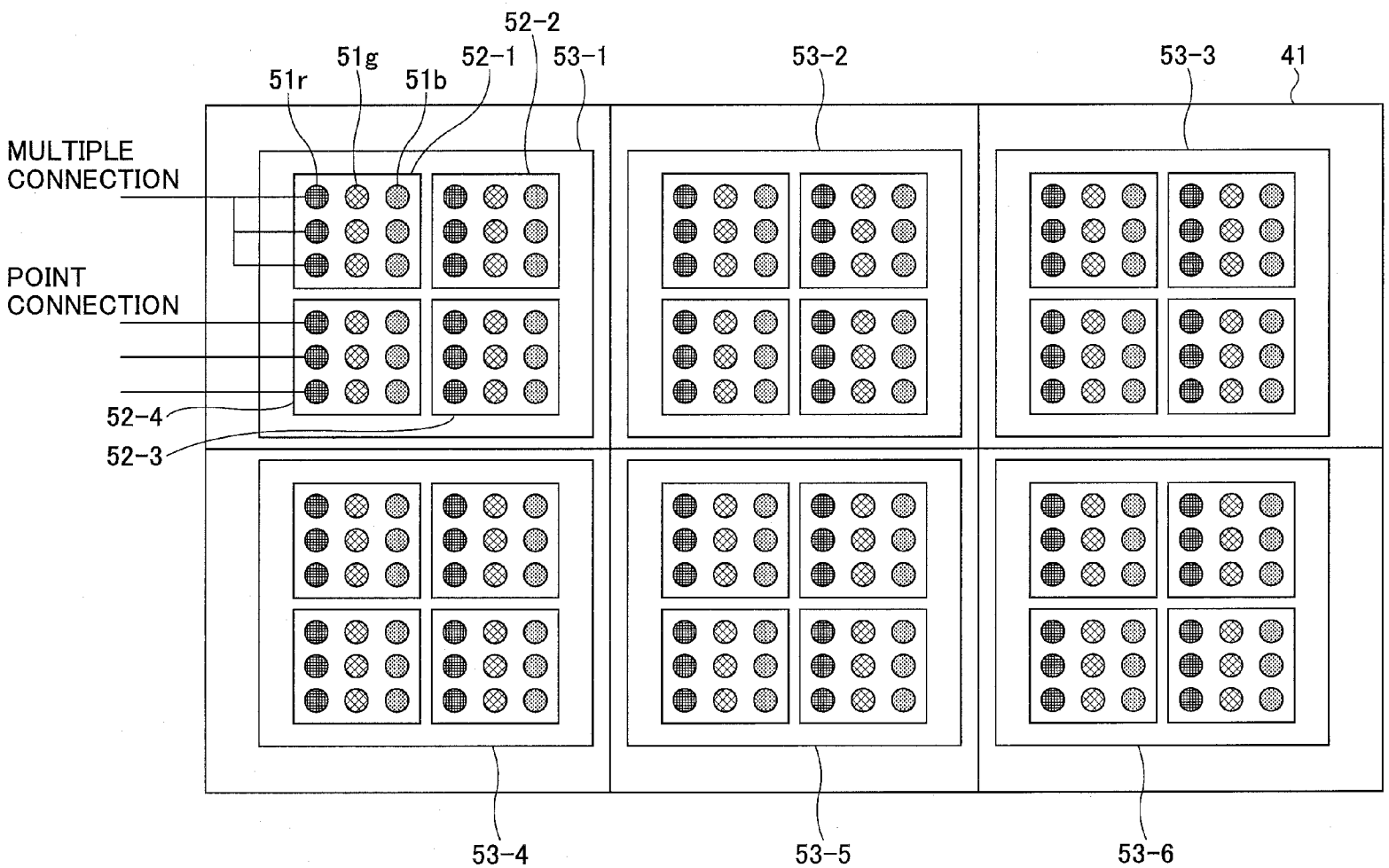
FIGS. 9A and 9B are diagrams showing examples of block information according to an embodiment.
Figure 9B:
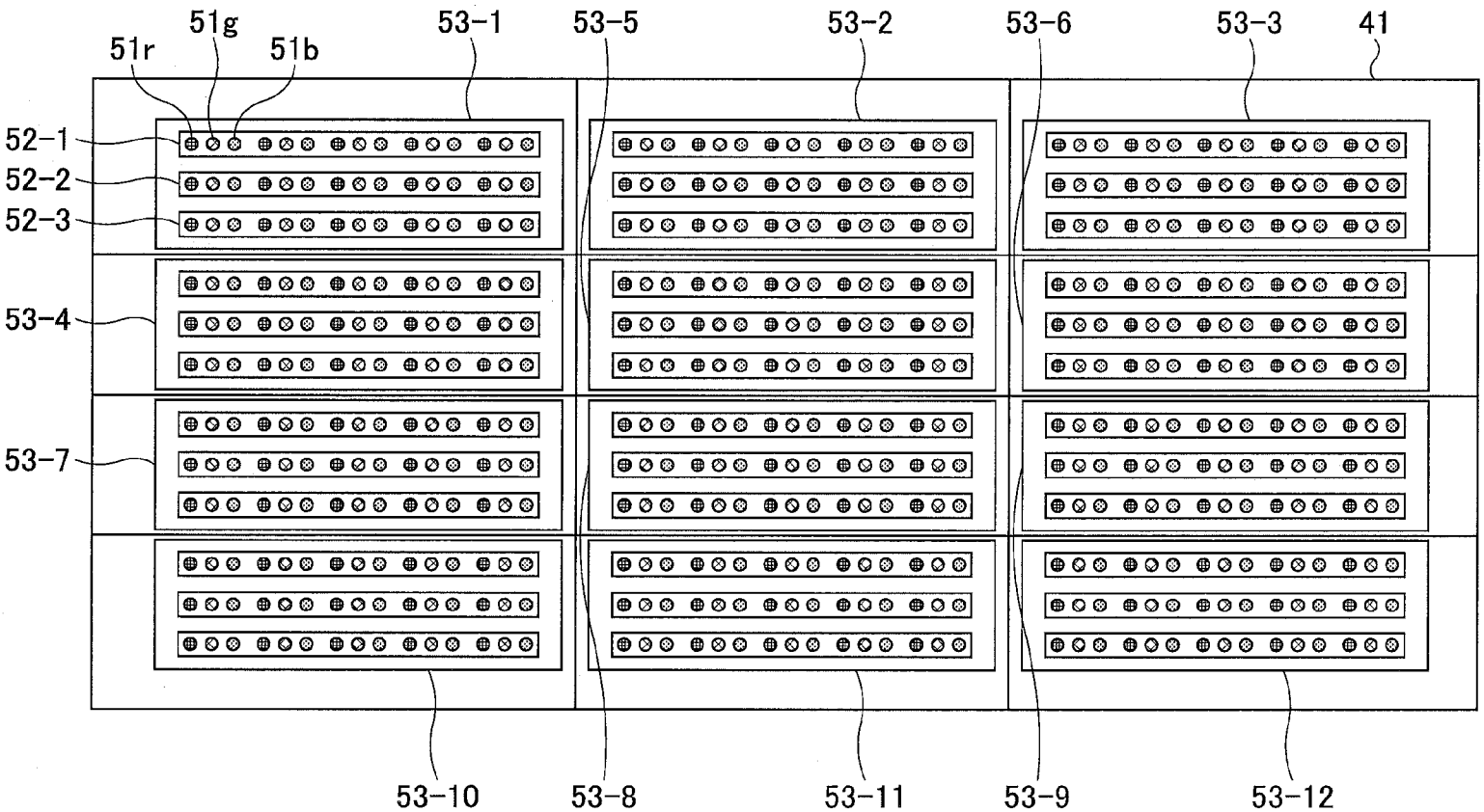

Next, examples of block configurations of the light-emitting elements (LEDs) are described with reference to Figures. FIGS. 9A and 9B show examples of block configurations of light-emitting elements that can be applied in the present embodiment. Each of FIGS. 9A and 9B shows LEDs for an LCD backlight.

As shown in FIGS. 9A and 9B, a predetermined screen display area of the LCD panel 41 includes elements 51*r*, 51*g* and 51*b* for R, G and B respectively. These elements are connected to a driver IC and the like by multiple connections or point connection.

Also, in the examples of FIGS. 9A and 9B, the elements 51*r*, 51*g* and 51*b* of the colors form a cell. In addition, in the examples of FIGS. 9A and 9B, a plurality of cells form an element block 52, and a predetermined number of element blocks 52 are placed at predetermined positions, which form a brightness control block 53 for performing control of brightness correction. In the present embodiment, although examples of the number and the placement of the blocks are shown in FIGS. 9A and 9B, the present embodiment is not limited to those. These are properly set according to screen size of the LCD panel 41 and the like.

The backlight shown in FIGS. 9A and 9B is a so-called top-type backlight that is placed on the backside of the LCD panel. But, the present invention is not limited to that type. For example, a configuration of a so-called edge type can be used in which the backlight is placed in the lower side of the screen of the LCD panel 41, or placed in one side (right side, left side) or both sides of the screen as shown in FIGS. 8A-8E.

Also, in the present embodiment, for example, in the case of FIGS. 9A, brightness blocks 53-1~53-6 are arranged on the backside of the LCD panel 41 at predetermined positions, and plural element blocks 52-1~52-4 are formed in each brightness block 53. Also, similarly, in the case of FIG. 9B, for the backlight of the LCD panel 41, plural element blocks 52-1~52-3 each of which includes plural LEDs are formed in each of brightness blocks 53-1~53-12.

In the present embodiment, brightness control may be performed on each of the elements 51*r*, 51*g* and 51*b* of the colors. Alternatively, brightness control may be performed for each of element blocks 52 or each of brightness blocks 53.

<Display Apparatus Including the Brightness Control Apparatus>

Next, an example of a configuration of a display apparatus including the brightness control apparatus is described with reference to a drawing.

Figure 10:
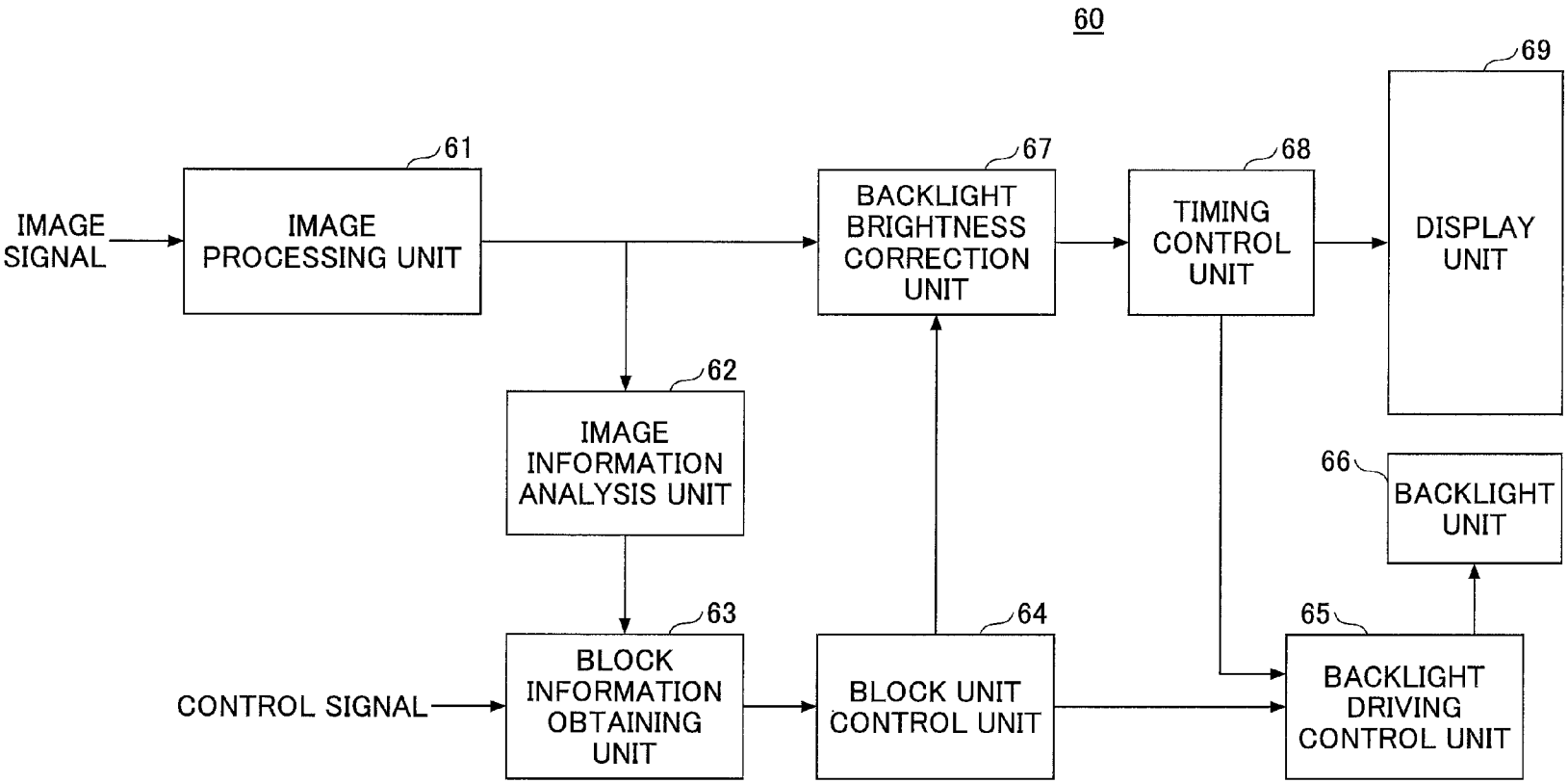
FIG. 10 is a diagram showing an example of a functional configuration of a display apparatus including a brightness control apparatus according to an embodiment.

FIG. 10 is a diagram showing an example of a functional configuration of a display apparatus including a brightness control apparatus of the present embodiment. The display apparatus 60 shown in FIG. 10 includes an image processing unit 61, an image information analysis unit 62, a block information obtaining unit 63, a block-unit control unit 64, a backlight driving control unit 65, a backlight unit 66, a backlight brightness correction unit 67, a timing control unit 68 and a display unit 69. In the present embodiment, for example, the backlight driving control unit 65 and the backlight unit 66 and the like include functions corresponding to the brightness control apparatus 10.

The image processing unit 61 decodes an input image signal in a case when the image signal is compression-coded. Also, in a case when the image signal is encrypted by scrambling and the like in a conditional reception broadcast system and the like, the image processing unit 61 decodes (descrambles) the input image signal using preset key information. That is, the image processing unit 61 properly converts the input image signal such that each unit of the latter stages can process the image signal and that an image can be displayed on the display unit 69. Also, the image processing unit 61 outputs the image signal to the image information analysis unit 62 and to the backlight brightness correction unit 67.

The image information analysis unit 62 detects, from the image signal supplied from the image processing unit 61, at least one piece of APL information, brightness histogram information, color histogram information (hue, saturation) and frequency histogram information, and the image information analysis unit 62 performs analysis on image information based on the detected information. That is, since the image information analysis unit 62 can obtain the histogram information and profile information and the like for the image (picture), brightness control for backlights corresponding to an image can be properly performed based on the information. The image information analysis unit 62 outputs an analysis result to the block information obtaining unit 63.

The block information obtaining unit 63 sets a size (the number of pixels, inches and the like) of a block unit based on the analysis result obtained by the image information analysis unit 62 and a preset control signal for the image signal. Accordingly, by setting the size of the block unit based on the image information and the like, the backlight can be controlled for each block, that is, in units of blocks, in association with image information.

In the present embodiment, when an image is divided into blocks, the image may be divided in units of pixels, or may be divided in units of square blocks such as 2×2 pixels, 4×4 pixels, 16×16 pixels and the like. But, the present invention is not limited to these.

Regarding timing of process execution in the block information obtaining unit 63, the block information obtaining unit 63 may perform the above-mentioned processing when the control signal is input from an outside part, for example. The block information obtaining unit 63 may also perform the above-mentioned processing when the analysis result is input from the image information analysis unit 62 based on preset control information, for example. The block information obtaining unit 63 outputs the obtained block information to the block-unit control unit 64.

The block-unit control unit 64 performs offset control and non-linear correction and the like for each block, for example, based on the block information obtained by the block information obtaining unit 63 in order to control brightness of backlight for each block corresponding to the image signal. Also, the block-unit control unit 64 performs pulse modulation processing on the input image signal by PWM in association with brightness control information of each block of the input image signal so as to generate a control signal. In addition, the block-unit control unit 64 outputs brightness control information for controlling brightness of LEDs at predetermined timing to the backlight driving control unit 65. Also, the block-unit control unit 64 outputs the above-mentioned brightness control information to the backlight brightness correction unit 67. Further, the block-unit control unit 64 outputs the offset control information and the non-linear correction information of each block to the backlight driving control unit 65 and to the backlight brightness correction unit 67.

The backlight driving control unit 65 performs driving control for backlights corresponding to each block position by using the brightness control information, the offset control information and the non-linear correction information and the like for each corresponding block obtained by the block-unit control unit 64, so that the backlight driving control unit 65 turns on LEDs of the backlight unit 66 at proper timing. Functions of the brightness control apparatus 10 and the driver IC 21 are mainly included in the backlight driving control unit 65. Therefore, as mentioned above, the backlight driving control unit 65 performs of processing of each of the PWM transmit unit 11, the dithering unit 12, the voltage control unit 13 and the current control unit 16, so as to perform above-mentioned variation correction and the like.

In addition, in the present embodiment, the backlight driving control unit 65 outputs a control signal for driving LEDs by timing control to the backlight unit 66 based on a clock signal from the timing control unit 68 in order to drive backlights in synchronization with the image signal output from the display unit 69 by the timing control unit 68.

Regarding the backlight unit 66, a backlight includes LED (Light Emitting Diode) elements of three colors (R (red), G (green) and B (blue)) respectively, the three colors being normally provided in an LCD. Therefore, it is desirable to perform adjustment for each LED element in order to adjust each pixel. However, in this case, remarkable cost and processing time are required. Thus, in the present embodiment, processing is performed for each one of blocks or for each set of plural blocks such as the above-mentioned element blocks or brightness blocks. Accordingly, cost reduction and efficiency can be realized.

The backlight driving control unit 65 outputs a respective control signal corresponding to each block to the backlight unit 66. The backlight unit 66 turns on backlights placed at predetermined positions of each block with a proper brightness level by performing brightness control set for each block based on the corresponding driving control signal, and irradiates the screen of the display unit 69 with light of the backlights.

The backlight brightness correction unit 67 performs brightness correction by using brightness control information for the backlight, with respect to the image signal obtained by the image processing unit 61 based on the brightness control information, the offset control information and the non-linear correction information obtained by the block-unit control unit 64. That is, the backlight brightness correction unit 67 performs trimming by performing reverse-correction on dimming control information of each block, so that the processed information is fed back to the image signal side.

The backlights are placed at the backside of the display unit 69, for example, and operate for each block for brightness control. Also, operation of the backlights is brightness operation of low resolution less than the resolution of the image signal. But, according to the present embodiment, block brightness interference due to difference of brightness resolution between the backlight and the image signal can be avoided, so that an optimal image that a user can easily watch can be displayed on the display screen of the display unit 69.

Also, the backlight brightness correction unit 67 performs correction of the image signal using the offset control information and the non-linear correction information, so that it becomes possible to perform control for brightness, contrast and color and the like as well as impulse control for backlights.

In the present embodiment, it is necessary that the backlight brightness correction unit 67 can properly adjust a correction amount even when information fed back to the image signal side changes according to the configuration of the brightness block, and even when brightness transmittance and the like of the display unit changes. In such a case, for example, the backlight brightness correction unit 67 can automatically adjust information to be fed back by using a result detected by a camera and the like for detecting brightness transmittance that is preset. The backlight brightness correction unit 67 outputs the image signal corrected by the above-mentioned processing to the timing control unit 68.

The timing control unit 68 performs control of time for displaying the image signal obtained by the backlight brightness correction unit 67 in conformity with the horizontal and vertical directions of the screen of the display unit 69, and generates image information displayed on the screen of the display unit 69 and outputs the generated image to the display unit 69.

In addition, in synchronization with the timing for outputting the image signal to the display unit 69, the timing control unit 68 outputs a timing control signal for turning on backlights corresponding to the image signal to the backlight driving control unit 65 in order to turn on the backlights of the backlight unit 66 in synchronization with the image displayed on the screen.

Accordingly, image output by the display unit 69 can be synchronized with backlight output of the backlight unit 66 corresponding to the image.

The display unit 69 displays image information generated by the timing control unit 68 on the screen. As the display unit 69, a LCD panel and the like can be used, for example. But, the present invention is not limited to using the LCD panel as the display unit 69.

According to the above-mentioned configuration, in the present embodiment, backlights of the display unit 69 such as the LCD panel can be dynamically operated in conjunction with image contents. Thus, images of higher contrast can be provided.

That is, according to the display apparatus 60 of the present embodiment, brightness of a backlight apparatus can be corrected in association with image contents displayed on the display unit 69, so that optimal backlight control can be performed according to image contents. In addition, brightness interference to image signals that occurs when performing various dimming operation in the LCD backlight can be improved, so that the dimming operation can be improved into more optimal operation.

Also, in the present embodiment, optical brightness control based on brightness histogram detection and the like can be realized in addition to reference brightness control process by the conventional APL detection. For example, by performing color histogram detection, LED backlight control for RGB can be performed according to optimal white balance control and the like. That is, in the present embodiment, the backlight brightness control may be performed by using only detection results of various histograms, and also the backlight brightness control may be performed by combining the APL detection result and the histogram detection results.

<Other Application Examples of the Brightness Control Apparatus>

The brightness control apparatus of the present embodiment can be applied to a lighting apparatus, a digital signage, and other various displays and the like as well as the above-mentioned display apparatus such as a TV. That is, the brightness control apparatus of the present embodiment can be applied to overall apparatuses that can drive light-emitting elements (LEDs) that are serially connected as mentioned above, for example. In the following, other application examples of the brightness control apparatus are described with reference to drawings.

Figure 11B:
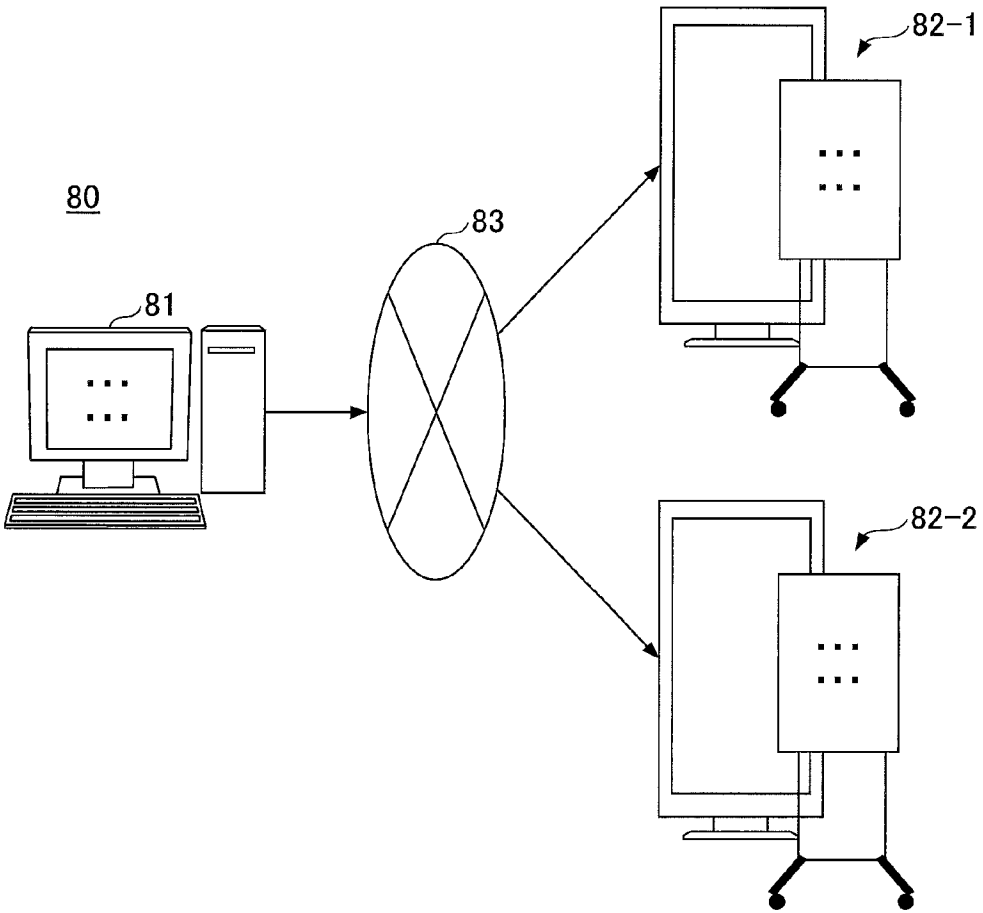
FIGS. 11A and 11B are diagrams for explaining other application examples including the brightness control apparatus according to an embodiment.
Figure 11A:
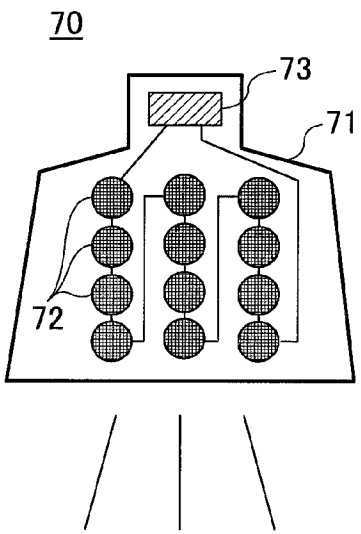

FIGS. 11A and 11B are diagrams for explaining other application examples including the brightness control apparatus of the present embodiment. FIG. 11A shows an example in which the brightness control apparatus of the present embodiment is applied to a lighting apparatus, and FIG. 11B shows an example in which the brightness control apparatus of the present embodiment is applied to a digital signage system.

The lighting apparatus 70 shown in FIG. 11A is an LED lamp as an example. More specifically, the lighting apparatus 70 is configured such that a plurality of LEDs 72 are serially connected in a lamp body 71, and each LED is placed at a predetermined position suitable for a proper lighting direction. LEDs 72 may be configured to be the above-mentioned light-emitting element block, or may be connected in parallel.

The LEDs 72 are connected to the above-mentioned driver IC 73 as shown in FIG. 11A. Driving of each LED is controlled by the driver IC 73 that includes functions of the brightness control apparatus. By adopting such a configuration, lighting can be realized by light emitted from the plurality of LEDs on which brightness control such as the above-mentioned variation corrections has been performed. In addition, in the present embodiment, a bypass circuit may be provided for each LED 72 shown in FIG. 11A. Therefore, according to the lighting apparatus 70, even when a break occurs in an LED, a current from the driver IC 73 can be supplied to the other LEDs.

The digital signage system 80 shown in FIG. 11B is configured, for example, to include a PC (personal computer) 81 and a plurality of digital signage apparatuses 82 (digital signage apparatuses 82-1 and 82-2 in the example of FIG. 11B). The PC 81 and the digital signage apparatuses 82 are connected via a communication network 83 represented by the Internet such that transmit and receive of data are available.

In the digital signage system 80 shown in FIG. 11B, contents such as product description and a company name that are created and edited using the PC 81 by a manager are displayed and updated simultaneously on the digital signage apparatuses 82 placed in different places via the communication network 83. Each digital signage apparatus 82 uses a large-sized liquid crystal display, for example, and the brightness control apparatus can be applied to such a large-sized liquid crystal display, so that similar effects can be obtained.

For example, also in the digital signage apparatuses 82 shown in FIG. 11B, the brightness control apparatus of the present embodiment is applied for the LEDs arranged as a backlight apparatus, so that stable brightness control can be performed. In addition, also in the configuration shown in FIG. 11B, by providing the above-mentioned bypass circuit for each LED, according to the digital signage apparatus 82, a current from the driver IC can be supplied to the other LEDs even when a break occurs in an LED. Further, the brightness control apparatus of the present embodiment can be also applied to backlights of a liquid crystal display of the PC 81 shown in FIG. 11B.

As mentioned above, according to the embodiment of the present invention, stable brightness control can be performed for backlights of the display apparatus and the lighting apparatus. That is, stable brightness and white balance can be always obtained for the backlights of the display apparatus and the lighting apparatus.

The brightness control apparatus of the present invention can be applied to a liquid crystal display apparatus including a liquid crystal display panel and backlights placed on the backside of the liquid crystal display panel, for example. But, the application of the present invention is not limited to that. For example, the brightness control apparatus of the present invention can be widely applied to various display screens having backlights such as a TV, a PC, a mobile terminal, a game machine, a digital camera and the like.

The present invention is not limited to the specifically disclosed embodiments, and variations and modifications may be made without departing from the scope of the present invention.

What is claimed is:

1. A brightness control apparatus configured to perform brightness control for backlights formed by plural light-emitting elements for a display screen, comprising:

a pulse control signal transmit unit configured to transmit a pulse control signal for performing driving control on the plural light-emitting elements based on a preset brightness control signal;

a voltage control unit configured to control a voltage of the pulse control signal obtained by the pulse control signal transmit unit for each set of light-emitting elements of the same color so as to correct brightness variation in a regular state for the plural light-emitting elements;

a current control unit configured to control a current for each of the plural light-emitting elements based on a voltage value obtained by the voltage control unit so as to correct brightness variation due to temperature change or temporal change, and a dithering unit configured to perform dithering for the pulse control signal obtained by the current control unit in which the brightness variation has been corrected, wherein the dithering unit controls brightness of the backlights by gray dimming processing using one or more gray frames.

2. The brightness control apparatus as claimed in claim 1, wherein the dithering unit performs dimming processing by inserting a white pixel line including plural pixels into a part of a black frame and moving the white pixel line or using a frame in which black parts of plural different pixel areas are inserted in a white frame so as to control brightness of the backlights.

3. The brightness control apparatus as claimed in claim 1, wherein the plural light-emitting elements include red, green and blue light-emitting elements, and the current control unit corrects brightness variation due to temperature change or temporal change for the green and the blue light-emitting elements by using, as a reference, a correction value for brightness variation due to temperature change or temporal change for the red light-emitting element.

4. The brightness control apparatus as claimed in claim 1, wherein the pulse control signal transmit unit controls output timing of the pulse control signal for different light-emitting elements.

5. A display apparatus comprising:

a brightness control apparatus; and a display unit illuminated by backlights that are light-emitting elements and that are controlled by the brightness control apparatus, the brightness control apparatus comprising:

a pulse control signal transmit unit configured to transmit a pulse control signal for performing driving control on the plural light-emitting elements based on a preset brightness control signal;

a voltage control unit configured to control a voltage of the pulse control signal obtained by the pulse control signal transmit unit for each set of light-emitting elements of the same color so as to correct brightness variation in a regular state for the plural light-emitting elements;

a current control unit configured to control a current for each of the plural light-emitting elements based on a voltage value obtained by the voltage control unit so as to correct brightness variation due to temperature change or temporal change, and a dithering unit configured to perform dithering for the pulse control signal obtained by the current control unit in which the brightness variation has been corrected, wherein the dithering unit controls brightness of the backlights by gray dimming processing using one or more gray frames.

6. A lighting apparatus comprising:

plural light-emitting elements;

a pulse control signal transmit unit configured to transmit a pulse control signal for performing driving control on the plural light-emitting elements based on a preset brightness control signal;

a voltage control unit configured to control a voltage of the pulse control signal obtained by the pulse control signal transmit unit for each set of light-emitting elements of the same color so as to correct brightness variation in a regular state for the plural light-emitting elements;

a current control unit configured to control a current for each of the plural light-emitting elements based on a voltage value obtained by the voltage control unit so as to correct brightness variation due to temperature change or temporal change, and a dithering unit configured to perform dithering for the pulse control signal obtained by the current control unit in which the brightness variation has been corrected, wherein the dithering unit controls brightness of the lighting apparatus by gray dimming processing using one or more gray frames.

* * * * *